US008085203B1

(12) United States Patent
Klein et al.

(10) Patent No.: US 8,085,203 B1
(45) Date of Patent: Dec. 27, 2011

(54) GROUND SURROUNDED NON-RESONANT SLOT-LIKE PATCH ANTENNA

(75) Inventors: Joseph Klein, Chatsworth, CA (US); Vladimir Kimelblat, Chatsworth, CA (US)

(73) Assignee: Aero Antenna Inc.

( * ) Notice: Subject to any disclaimer, the term of this patent is extended or adjusted under 35 U.S.C. 154(b) by 401 days.

(21) Appl. No.: 12/426,032

(22) Filed: Apr. 17, 2009

Related U.S. Application Data

(60) Provisional application No. 61/046,027, filed on Apr. 18, 2008.

(51) Int. Cl.
*H01Q 1/38* (2006.01)

(52) U.S. Cl. ..... 343/700 MS; 343/846

(58) Field of Classification Search ..... 343/700 MS, 343/702, 846
See application file for complete search history.

(56) References Cited

U.S. PATENT DOCUMENTS

| | | | | |
|---|---|---|---|---|
| 4,907,006 | A | 3/1990 | Nishikawa et al. | |
| 5,200,756 | A | 4/1993 | Feller | |
| 5,337,066 | A | 8/1994 | Hirata et al. | |
| 5,400,040 | A | 3/1995 | Lane et al. | |
| 5,929,812 | A | 7/1999 | Aminzadeh | |
| 7,102,573 | B2 * | 9/2006 | Morrow et al. | 343/700 MS |
| 7,501,990 | B2 * | 3/2009 | Stutzke | 343/770 |

* cited by examiner

*Primary Examiner* — Hoang V Nguyen

(57) ABSTRACT

The present invention is a single or multiple non-resonant slot antenna where said slots are formed from a continuous upward extension of the conducting ground plane with lateral horizontal planar extensions to form a top plane defining said slots.

11 Claims, 6 Drawing Sheets

GROUND SURROUNDED NON-RESONANT SLOT-LIKE PATCH ANTENNA

This application claims benefit and priority of and is a continuation in part of a provisional application with Ser. No. 61/046,027 filed on Apr. 18, 2008, titled "Ground Surrounded Non-Resonant Slot-Like Patch Antenna".

FIELD OF THE INVENTION

The present invention relates to ground surrounded patch antenna or to the general field of non-resonant slot-like antennas.

BACKGROUND OF THE INVENTION

Electromagnetically coupled patch antennas have been long known in the art. In this technical field, a parasite resonant element and an exciting element (exciter) combine to produce the desired transmission and reception functions. FIG. 1 shows a prior art proximity coupled antenna 10. The exciting element 11 is located at a ground surface and is connected to a signal source via a connector. A radiating element or parasitic element 12 is spaced at distance above the exciter 11. Exciter 11 is secured to the surface of the ground plane 13 function as a primary and secondary transformer adapted to act as a doubly tuned circuit.

Electromagnetically coupled patch antennas can be used in general broadband broadcast and reception with high gain. However, the secondary element 12 must be elevated above the ground plane 13 and must not share any effective connection. It is difficult to maintain a required separation distance in environments where severe physical vibration or shock will affect the antenna.

U.S. Pat. Nos. 5,400,040 and 5,337,066 disclose patch antenna structures where all elements are substantially located upon a single planar surface to accommodate use in environmentally difficult locations. U.S. Pat. Nos. 4,907,006 and 5,200,756 disclose a parasitic element which descends to the level of a ground plane. U.S. Pat. No. 5,929,812 discloses parasitic elements short circuited to a ground plane. While the prior art contains certain disparate attempts to provide a rugged patch antenna, such prior art patch antennas are still constructed in a manner in which vibration and shock will tend to cause decreased performance over time.

There is a need for an antenna with identical or superior performance for placement in severe environments without adverse effects.

SUMMARY OF THE INVENTION

The present invention is a single or multiple non-resonant slot antenna where said slots are formed from a continuous upward extension of the conducting ground plane with lateral horizontal planar extensions to form a top plane defining said slots.

FIG. 2 shows the antenna of FIG. 1 but adding illustration of the presence of the electric field 13A in the substrate of a patch antenna 10. Note that the electric field is zero along a line 14 in the middle of the patch antenna 10. This null line suggests that if the patch antenna 10 is connected to the ground plane at a point on this line, it will not perturb the field significantly, thereby indicating an ideal set of locations for supporting elements from the ground plane 13. This support connection will also improve the radiation performance of the patch by shorting some spurious current modes on the patch.

Therefore, the first step in designing the current invention is to ground the antenna at two side locations as shown in FIG. 3 at pins 15. This support and electrical connection makes the whole radiating element 12 and ground plane 13 perform as one radiating conductor as shown in the present invention in FIG. 4.

In the invention, a radiating surface is elevated above, electrically connected with, and supported from a peripheral metallic or conducting base. A structural combination of a radiating element and a part of a ground plane is achieved in the invention patch antenna with a dramatically different structure, i.e., a perimeter forming a structural base and extension of a ground plane rises in a center portion to support a radiating element by relatively narrow supports within non-resonant slots.

A partial peripheral gap or slot about the radiating element is similar to radiating slots of a slot-type antenna. In the invention antenna, the partial peripheral gap, in contrast to prior art radiating slots, are non-resonant and do not form part of the radiator. The radiating element is surrounded by a ground plane. This has been verified by providing an exciter underneath the radiating element. The gap or slot is optionally be filled with a dielectric material as required by the application.

It is an object of the invention to provide a rugged antenna formed to be used in rough environments. The exciting element and a complementary part of the ground plane can be connected to the underside of a cavity formed under a central part of the elevated section as shown in FIG. 5.

This form of antenna element can be used as a basic element of a planar array to form a larger aperture for increased gain. Multiple radiators can be fed by one exciter as shown in FIG. 6. Another embodiment includes a single radiator with multiple exciting elements to form dual polarized antennas circular antennas or improve the impedance matching or connect to several sources.

This concept can be used to design low profile circularly polarized by using several radiators and excite them appropriately to form a radiating circular wave.

Another embodiment of the invention antenna is a multi-frequency version which one skilled in the art of antenna design can design variances to this antenna and base it on this invention similar to basic microstrip antennas.

DETAILED DESCRIPTION OF THE INVENTION

The invention is now discussed with reference to the figures.

Figure 1:
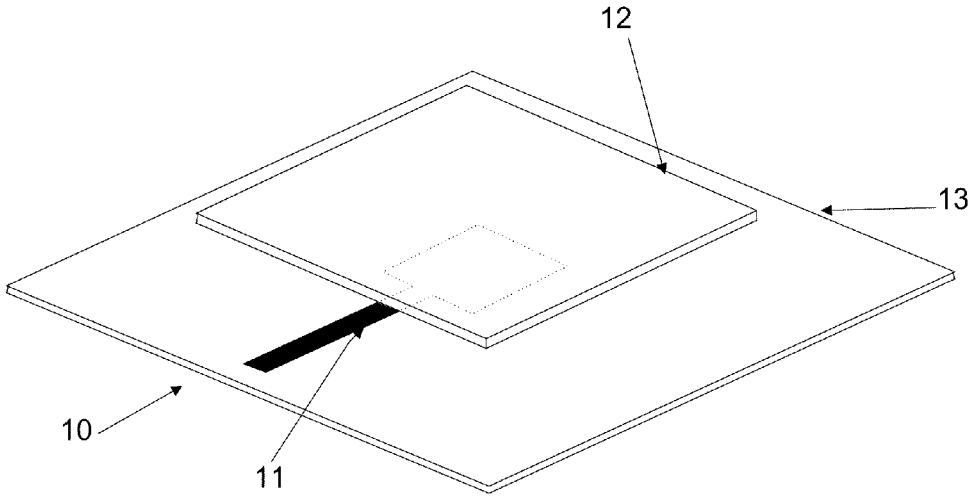
FIG. 1 PRIOR ART
FIG. 1 shows a traditional electromagnetically fed patch antenna, where an exciter connected to a source of energy is coupled to the radiating element through the exciter.
Figure 2:
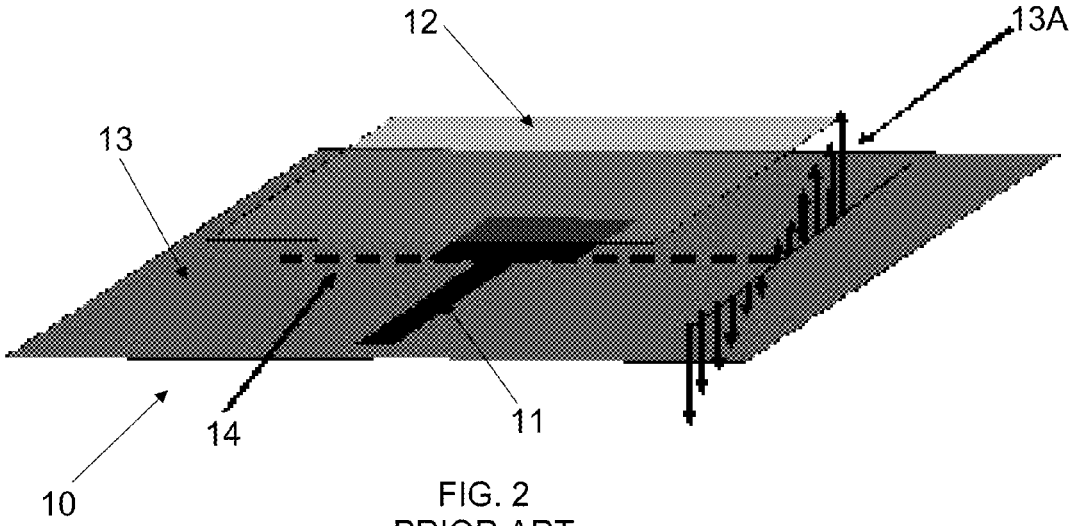
FIG. 2 PRIOR ART
FIG. 2 shows the electric field distribution in the substrate of a patch antenna. The field is zero along a line in the middle of the patch.

FIG. 1 shows a well known prior art electromagnetically fed patch antenna as described above. FIG. 2 shows the electric field 13A distribution in the substrate of a patch antenna 10 with a radiating element 12 elevated above a ground plane 13. The field 13A is zero along a null line 14 in the middle of the patch. The invention antennas are constructed to form a structurally rugged perimeter base rising in a center portion to create an elevated section co-planar with one or more radiating elements rigidly supported above and electromagnetically driven by an exciting element directly connected to a signal source. The structurally strong supports connecting the radiating elements to the elevated ground plane are co-linear with the zero or null line established by the interaction of the exciting element with the radiating element. This combination provides an almost indestructible cover for the exciting element located within a cavity formed beneath the radiating element. The perimeter base, elevated section and radiating element are formed as a single continuous piece of conductive material appropriate for the objects of the invention, such as copper or alloys thereof.

Figure 3:
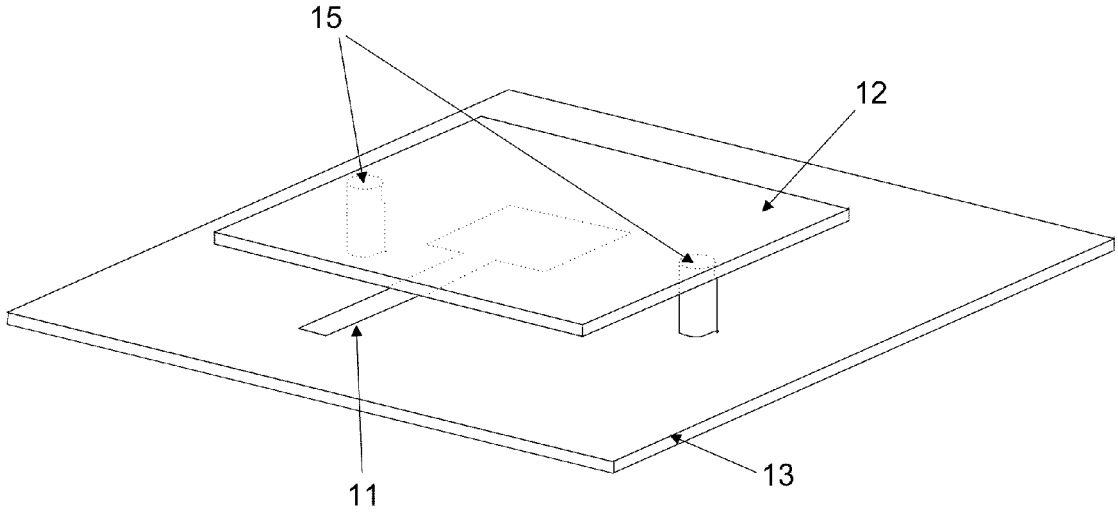
FIG. 3 shows grounding connections of the patch antenna at two locations along the zero-field line on the patch.

FIG. 3 is a generalized model for grounding and electrically effective support of the radiating element 12 from the ground plane 13. Grounding pins 15 support the radiating element 12 at two locations along the zero-field line on the patch. The effect of such grounding is to form a substantially different antenna than that shown in FIG. 1.

Figure 4:
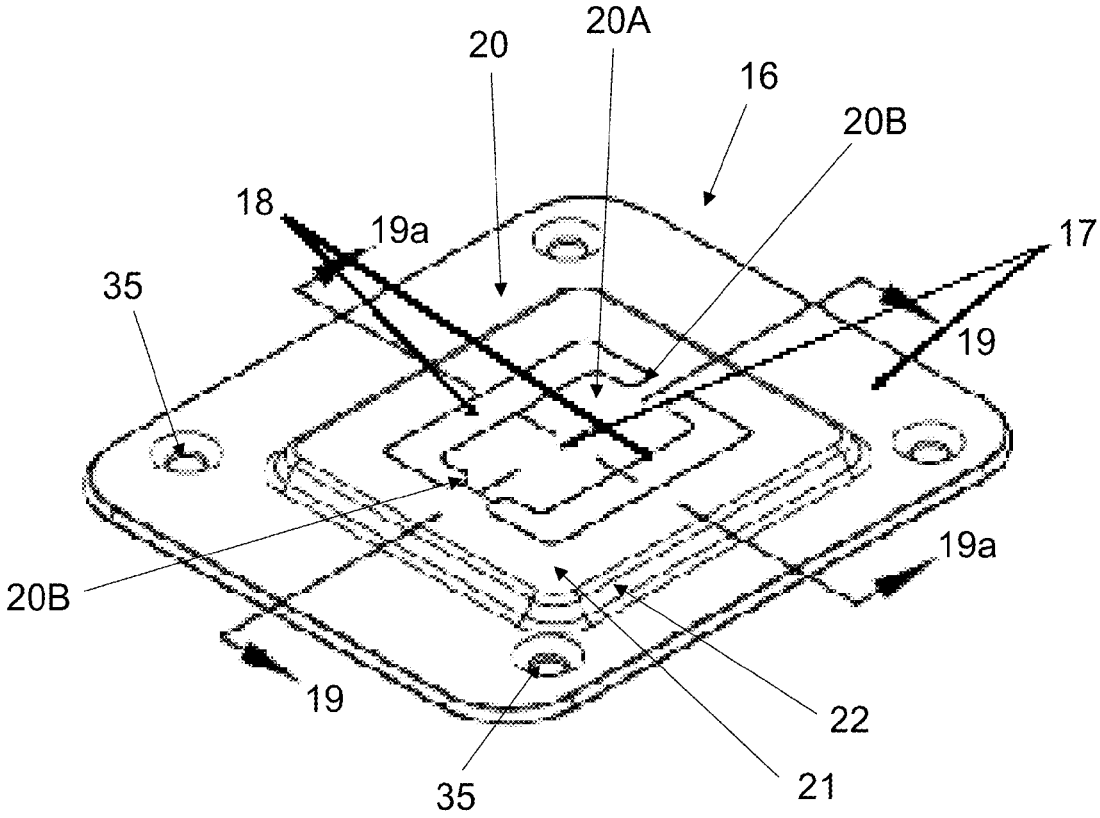
FIG. 4 shows the current invention which is a one piece metal which forms the radiator and ground plane.

FIG. 4 shows a single element antenna 16 of the invention. It should be appreciated that piece 17 is a single structurally formed piece comprising a ground plane section 20, transition 22, elevated section 21, zero line supports 20B, and radiating element 20A, where non-resonant slots 18 are defined by edges of the radiating element 20A, zero line supports 20B and elevated section 21. Ground plane section 20 and radiating element 20A are functional equivalents of the radiating element 12 and an outer part of ground plane 13 of FIG. 3.

Referring again to FIG. 4, radiating element 20A and ground plane section 20 are vertically spaced apart and horizontally parallel. Radiating element 20A is rigidly supported by zero line supports 20B substantially narrower than radiating element 20A above a single exciting element (not shown), thereby forming zero line supports at two planar connections for radiating element 20A along the electrical field zero line, which lies along cross section 19 line. Ground plane section 20 surrounds and peripherally transitions up at stepped transition 22 to the elevated section 21. Non-resonant slots 18 generally have an appearance of resonant slots in the prior art but are very different in this embodiment of the invention. Non-resonant slots 18 must be non-resonant to the resonant frequency of the typically narrow band of the invention antenna. Radiating element 20A, zero line supports 20B and a part of the elevated section 21 have undersides defining a cavity beneath piece 17 for rigid and secure attachment of an exciting element and a complement section of a ground plane. Screw holes 35 are formed in ground plane section 20 to provide for immediate attachment of antenna 16 to an appropriate surface. It is apparent from inspection of antenna 16, which is drawn to scale, that its structural strength is superior to the patch antenna structures described in the prior art.

Figure 5:
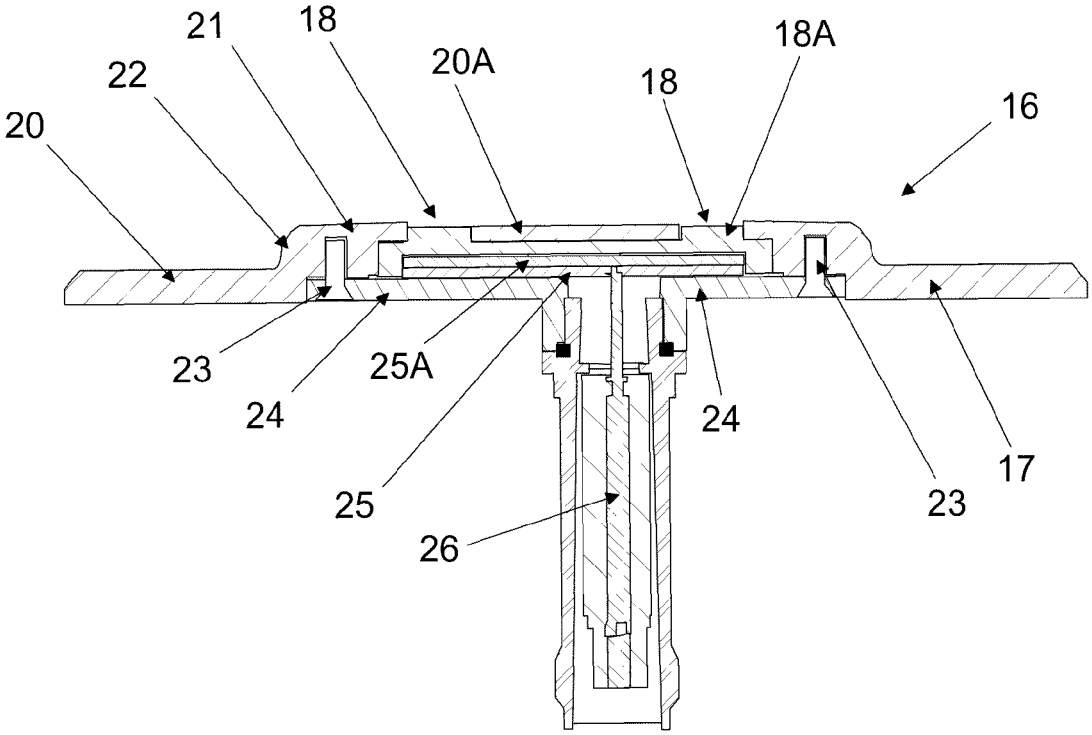
FIG. 5 shows the cross section 19*a* of ground surrounded non-resonant slot-like patch antenna in FIG. 4.

FIG. 5 shows cross section 19*a* of FIG. 4. Patch antenna 16 further comprises a complementary ground plane section 24 structurally and electrically connected to piece 17 via two or more connection pins 23, an exciting element 25A connected to a signal source via a connector 26 and which is electrically insulated from radiating element 20A and ground plane sections 20 and 24 by dielectric fill sections 18A and 25. It will be appreciated that radiating element 20A, zero line supports 20B and a part of the elevated section 21 have undersides defining a cavity beneath piece 17 within which to secure complementary ground plane section 24 and exciting element 25A by way of pins 23 and dielectric fill sections 18A and 25. Causing piece 17 to be secured to a flat surface by way of the screw holes or other attachment means further encases otherwise sensitive exciting element 25A to be secured as substantially a single, structurally secure unit adapted to survive with full functionality in an environment of severe vibration and shock. It will be appreciated that complementary ground plane section 24 is substantially rectangular and parallel to radiating element 20A, section 24 also defining a central opening for passage of connector 26 to exciting element 25A.

Figure 6:
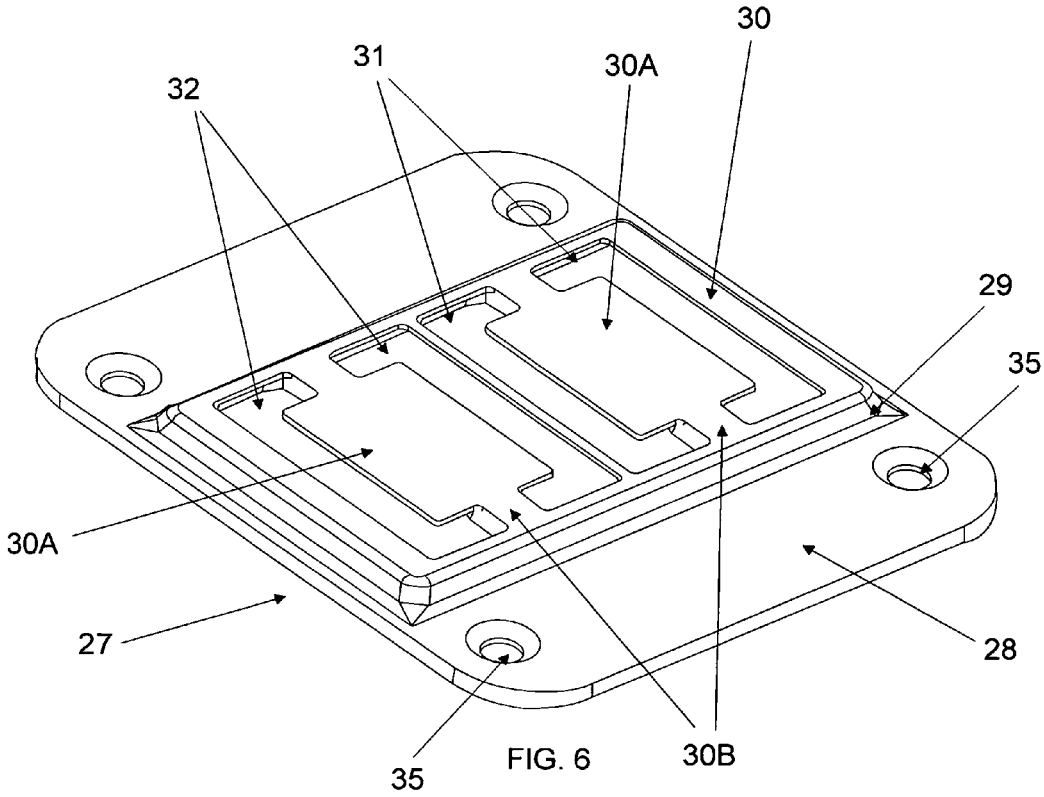
FIG. 6 shows a two element configuration of the current invention fed by one exciter.

FIG. 6 shows a two element antenna 27 of the current invention fed by one exciting element (not shown, but similar in structure and location beneath the radiating elements as the structure shown in FIGS. 4 and 5). Ground plane section 28 surrounds transition 29 to elevated section 30, which provides zero line supports 30B to two radiating elements 30A, which in turn define non-resonant slots 31 and 32.

The above design options will sometimes present the skilled designer with considerable and wide ranges from which to choose appropriate apparatus and method modifications for the above examples. However, the objects of the present invention will still be obtained by that skilled designer applying such design options in an appropriate manner.

We claim:

1. A patch antenna assembly comprising a radiating element supported by structurally rigid and co-planar zero line supports parallel to and elevated above a zero line of an exciting element fixed underneath said radiating element, said zero line supports connected to an elevated section whose central portion defines a pair of non-resonant slots on two sides of the radiating element and where the elevated section is supported from a perimeter base, where the perimeter base, elevated section, zero line supports and radiating element are formed from a single conductive and structurally integrated piece.

2. The assembly of claim 1 wherein the perimeter base forms a portion of a ground plane at a level below a plane defined by the radiating element.

3. The assembly of claim 2 where a cavity is formed beneath the radiating element, zero line supports, and a central part of the elevated section.

4. The assembly of claim 3 wherein the exciting element is located within said cavity directly underneath the radiating element.

5. The assembly of claim 4 wherein a complementary ground plane section is fixed to an underside of the elevated section.

6. The assembly of claim 5 wherein the complementary ground plane section is electrically connected the underside of the elevated section so that it effectively forms a ground plane with the perimeter base.

7. The assembly of claim 6 wherein the ground plane is located beneath a planar exciting element.

8. The assembly of claim 7 wherein the exciting element is connected to a signal source at a center point.

9. The assembly of claim 8 wherein the ground plane defines an opening in its center so that a connection to a signal source passes through said opening to the exciting element.

10. The assembly of claim 9 wherein the perimeter base comprises attachment means for attachment of an underside of the assembly to a planar surface.

11. A patch antenna assembly comprising two more radiating elements, each radiating element supported by structurally rigid and co-planar zero line supports parallel to and elevated above a zero line of an exciting element fixed underneath said radiating element, said zero line supports connected to an elevated section whose central portion defines a pair of non-resonant slots on two sides of the radiating element and where the elevated section is supported from a perimeter base, where the perimeter base, elevated section, zero line supports and radiating element are formed from a single conductive and structurally integrated piece.

* * * * *